US008766817B2

(12) United States Patent
Sri-Jayantha

(10) Patent No.: US 8,766,817 B2
(45) Date of Patent: Jul. 1, 2014

(54) ROAD HAZARD DETECTION AND WARNING SYSTEM AND METHOD

(75) Inventor: Sri M Sri-Jayantha, Ossining, NY (US)

(73) Assignee: International Business Machines Corporation, Armonk, NY (US)

( * ) Notice: Subject to any disclaimer, the term of this patent is extended or adjusted under 35 U.S.C. 154(b) by 532 days.

(21) Appl. No.: 13/041,766

(22) Filed: Mar. 7, 2011

(65) Prior Publication Data

US 2012/0229302 A1 Sep. 13, 2012

(51) Int. Cl.
*G08G 1/09* (2006.01)
*G08B 1/08* (2006.01)

(52) U.S. Cl.
USPC ... 340/905; 340/988; 340/995.1; 340/539.18; 701/1

(58) Field of Classification Search
USPC ..... 340/901, 904, 905, 988, 989, 435, 439, 340/472, 995.1, 995.13, 539.1, 340/539.11–539.15, 539.18; 702/3; 701/213, 1, 301
See application file for complete search history.

(56) References Cited

U.S. PATENT DOCUMENTS

| | | | | |
|---|---|---|---|---|
| 6,405,132 | B1 | 6/2002 | Breed et al. | 701/301 |
| 6,583,734 | B2 * | 6/2003 | Bates et al. | 340/988 |
| 6,690,291 | B1 | 2/2004 | Cardillo et al. | 340/901 |
| 7,095,136 | B2 | 8/2006 | Rowledge | 307/10.8 |
| 7,378,986 | B2 * | 5/2008 | Eckstein et al. | 340/902 |
| 2003/0065432 | A1 | 4/2003 | Shuman et al. | 701/48 |
| 2004/0107042 | A1 | 6/2004 | Seick | 701/117 |
| 2004/0130446 | A1 * | 7/2004 | Chen et al. | 340/539.12 |
| 2006/0015254 | A1 * | 1/2006 | Smith | 702/3 |
| 2007/0078570 | A1 * | 4/2007 | Dai et al. | 701/1 |
| 2009/0072997 | A1 * | 3/2009 | Shrum, Jr. | 340/905 |
| 2009/0243882 | A1 | 10/2009 | Brown et al. | 340/905 |

* cited by examiner

*Primary Examiner* — Anh V La
(74) *Attorney, Agent, or Firm* — Harrington & Smith

(57) ABSTRACT

Exemplary embodiments of this invention encompass a method that includes receiving information packets transmitted from a plurality of vehicles, each information packet including at least a location of a vehicle that transmits the information packet; analyzing the plurality of information packets to infer a presence of a transportation hazard at a particular location and a type of transportation hazard as being one of a static or a dynamic transportation hazard; and transmitting warning information descriptive of the particular location and the type of transportation hazard for reception at least by vehicles likely to encounter the transportation hazard. In another aspect the exemplary embodiments encompass a method that includes manually activating a transducer in a vehicle in response to observing an actual or a potential transportation hazard and, in response to the manual activation, wirelessly transmitting from the vehicle at least one information packet that includes at least a current location of the vehicle when the information packet is transmitted.

22 Claims, 12 Drawing Sheets

ROAD HAZARD DETECTION AND WARNING SYSTEM AND METHOD

TECHNICAL FIELD

The exemplary embodiments of this invention relate generally to vehicular safety and monitoring systems.

BACKGROUND

Many of the traffic accidents that occur each year result in serious injury and fatalities. Some of these traffic accidents are directly caused by unexpected road hazards such as fallen trees or branches, stones falling onto the roadway and cargo or debris falling from trucks and trailers. At least some of the 40,000 road accidents that occur within the United States alone each year could be avoided if an intelligent transportation infrastructure was deployed.

SUMMARY

The foregoing and other problems are overcome, and other advantages are realized, in accordance with the exemplary embodiments of this invention.

In a first aspect thereof the exemplary embodiments encompass a method that comprises receiving information packets transmitted from a plurality of vehicles, each information packet comprising at least a location of a vehicle that transmits the information packet; analyzing the plurality of information packets to infer a presence of a transportation hazard at a particular location and a type of transportation hazard as being one of a static or a dynamic transportation hazard; and transmitting information descriptive of the particular location and the type of transportation hazard for reception at least by vehicles likely to encounter the transportation hazard.

In another aspect the exemplary embodiments provide a method that comprises manually activating a transducer in a vehicle in response to observing an actual or a potential transportation hazard and, in response to the manual activation, wirelessly transmitting from the vehicle at least one information packet comprising at least a current location of the vehicle when the information packet is transmitted.

In another aspect the exemplary embodiments provide a system that comprises at least one data processor operating in accordance with a computer program, where execution of the computer program results in performing operations that comprise receiving information packets transmitted from a plurality of vehicles, each information packet comprising at least a location of a vehicle that transmits the information packet; analyzing the plurality of information packets to infer a presence of a transportation hazard at a particular location and a type of transportation hazard as being one of a static or a dynamic transportation hazard; and transmitting information descriptive of the particular location and the type of transportation hazard for reception at least by vehicles likely to encounter the transportation hazard.

In yet another aspect the exemplary embodiments provide a system that comprises at least one data processor operating in accordance with a computer program. The system further comprises a manually activated in-vehicle transducer. In the system execution of the computer program results in performing operations that comprise, in response to an activation of the transducer by an occupant of the vehicle, wirelessly transmitting from the vehicle at least one information packet comprising at least a current location of the vehicle when the information packet is transmitted.

DETAILED DESCRIPTION

The exemplary embodiments of this invention provide a system configured to perform real time identification of transportation-centric hazards and thus enhance road safety. A service infrastructure integrates a simple response from persons on the road to generate real time hazard information that is analyzed and, if appropriate, a warning can be transmitted to other persons on the road determined to be in a position to benefit from warning.

Digital and automotive technology have evolved to a level of maturity such that vehicle location information and the real time display of local area routes are or will be a common feature in most if not all vehicles. The exemplary embodiments of this invention enable an infrastructure that provides a unified frame work through which vehicles can share critical road hazard information through communication links.

Figure 1:
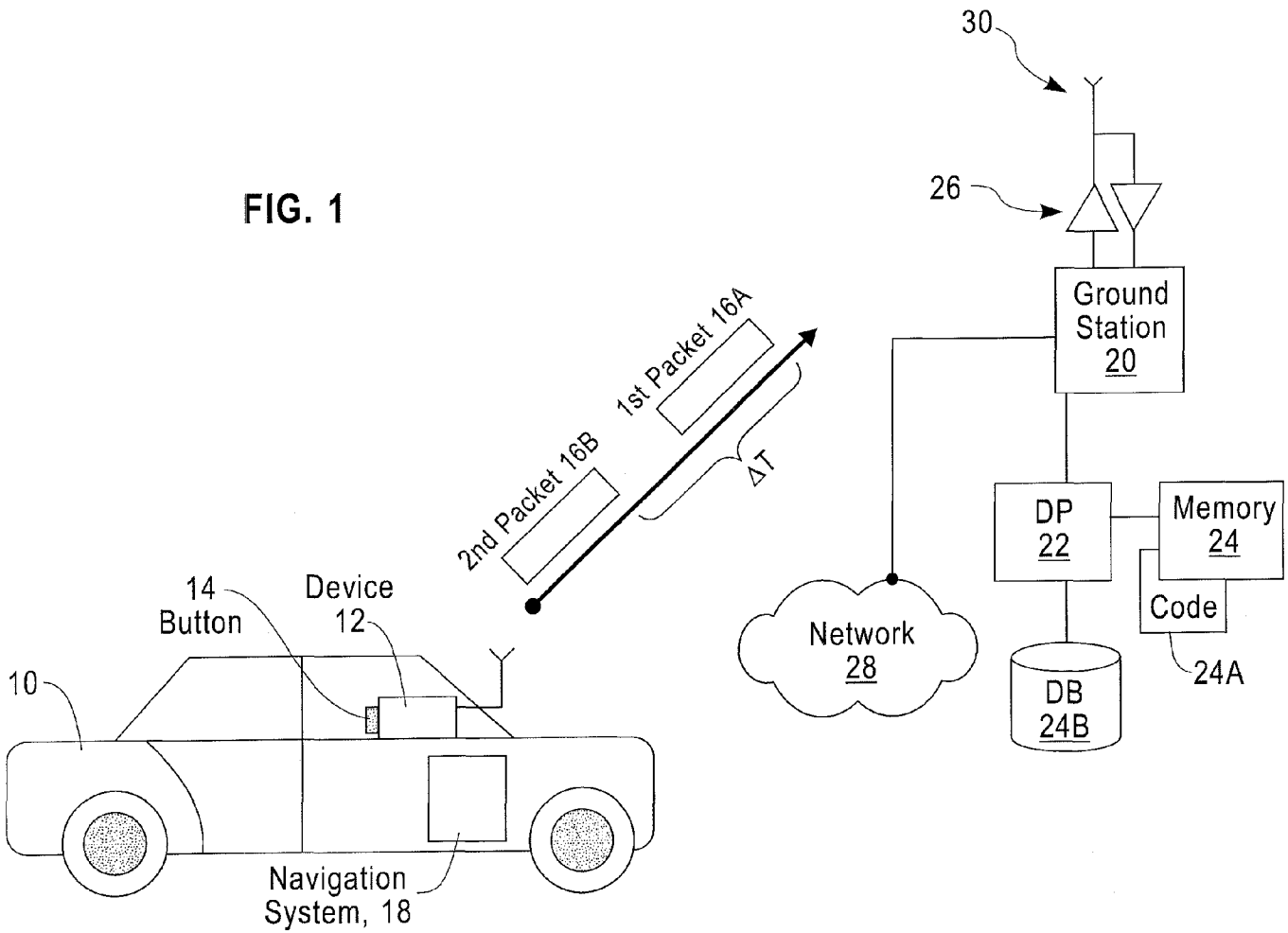
FIG. 1 is a simplified system block diagram of a vehicle and a service infrastructure system embodied as a hazard detection and notification system and algorithms component.

In one exemplary embodiment shown in FIG. 1 a vehicle 10 includes an electronic device 12 with a simple user (e.g., driver) activated transducer such as a push button 14. The button 14 is placed in the vehicle 10 where it can be easily activated by the driver. When the driver (or any person in the vehicle) activates the button 14, which can be referred to below as a "click", in response to the presence of some hazard or potential hazard, an information packet 16A is transmitted wirelessly from the electronic device 12 to a ground station 20. The information packet 16A includes at least the current location of the vehicle 10 as derived from, for example, an on-board GPS receiver (or a GPS receiver internal to the device 12). The information packet 16A can also include if available a current velocity of the vehicle, as well as a current heading of the vehicle. Alternatively, the information packet is sent again as a second information packet 16B. The second information packet 16B also includes at least the current location of the vehicle 10, and it may also include an indication of an elapsed time (ΔT) since the first information packet 16A was transmitted. Using the first and second locations and (ΔT) as received in the second information packet 16B or, alternatively, as calculated by the ground station 20 as the difference between the time-of-arrival (TOA) of the first information packet 16A and the TOA of the second information packet 16B, the velocity and direction (heading) of the vehicle 10 can be computed by the ground station 20.

The ground station 20 can be considered to be an element of an always-on (24/7) service infrastructure system, which can be referred to without a loss of generality, as a hazard detection and notification system and algorithms 30. The ground station 20 receives the information packets 16 transmitted from various vehicles 10. The ground station 20 includes or is connected or networked with at least one computer or data processor (DP) 22 that is connected with at least one memory 24 storing computer program code 24A that, when executed by the at least one data processor 22, results in the performance of methods of this invention. The data processor 22 can also be connected with at least one database 24B that stores data related to at least the received information packets 16. The database 24B can be referred to below as a click database. The database 24B can be a part of the memory 24, or it may be a separate data storage entity as shown in FIG. 1.

In general the ground station 20 analyses information packets 16 received via a wireless transceiver 26 and infers or estimates the likelihood that a hazard is present, as well as inferring or estimating the nature of the hazard. Depending on various statistical analyses, and the intensity (numbers) of information packets 16 being received from various vehicles 10, analytic algorithms process the data packets. Information such as hazard location, the presence of reckless drivers, the presence of drivers driving under the influence and/or other problematic situations can be inferred from the data set in real time. The results of the analysis can then be transmitted via any suitable type of network 28 to appropriate organizations (e.g., law enforcement, road maintenance authorities) and/or to other vehicles so that appropriate actions can be initiated. If a display of a route map is available in a vehicle receiving the transmission (e.g., if a GPS-based vehicle navigation system 18 is present) the hazard location information can be transmitted to at least some vehicles 10 via the transceiver 26 for being rendered or presented to the driver, such as by being superimposed on the route map display of the vehicle navigation system 18.

The wireless transmissions can be of any suitable type, and may use licensed or unlicensed radio bands.

A business process can be provided by either charging individual customers or agencies, such as auto insurance companies, for the hazard-related information.

Various hazardous situations that can possibly be encountered on a road can be static. These are basically fixed in position, for example, an object left by a previous vehicle, a pothole, an area of "black ice", or some object falling into the road from the side of the road. Various hazardous situations that can possibly be encountered on a road can be transient, i.e., those that are present for a short period of time, for example, a passing storm or a deer herd crossing a highway. In addition, various hazardous situations that can possibly be encountered on a road can be dynamic in nature and constantly changing in position, for example, a reckless (possibly impaired) driver or a storm moving generally in the same direction as the road.

Figure 2:
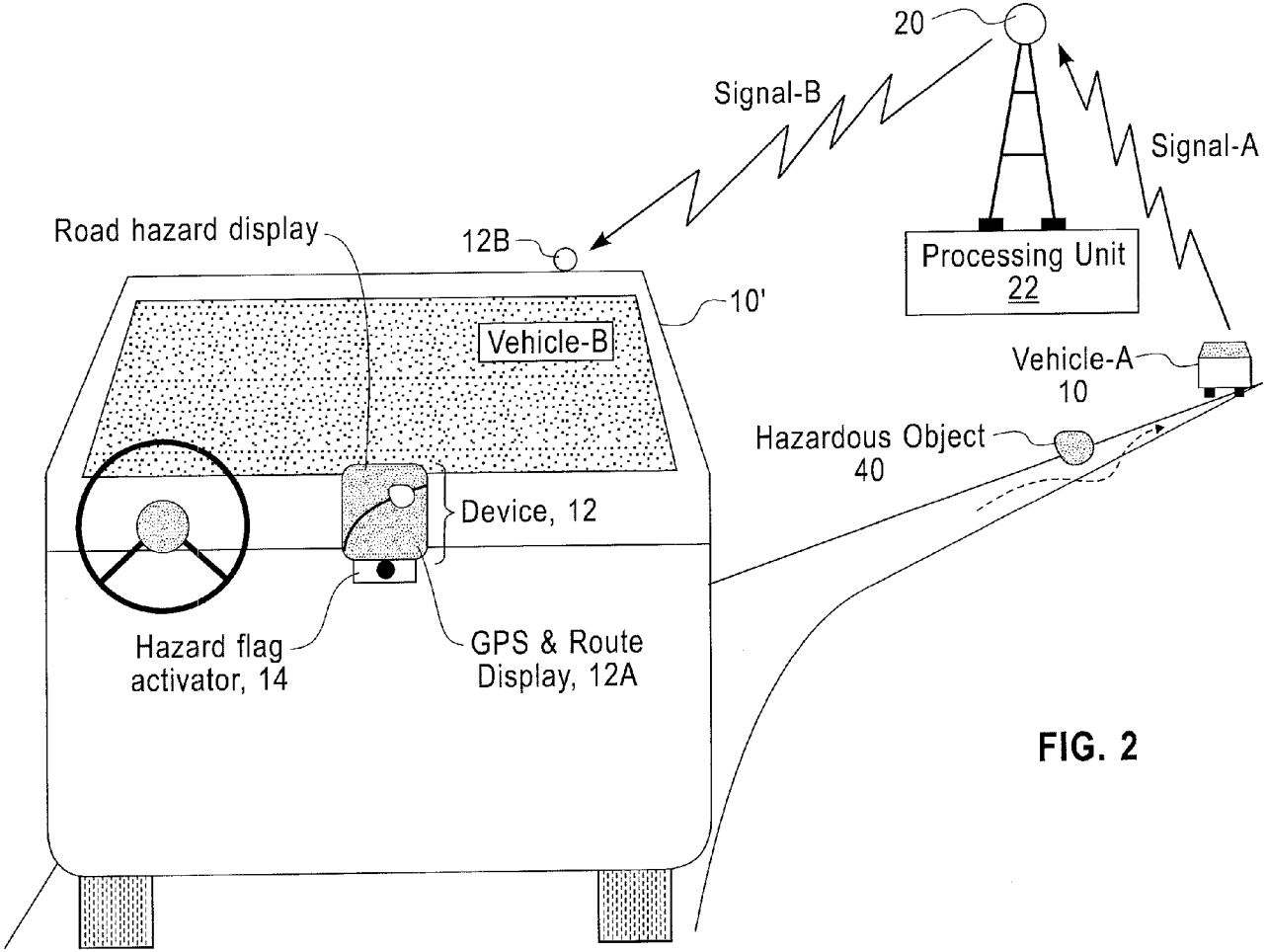
FIG. 2 is useful in describing the overall operation of the exemplary embodiments and depicts a situation where an object is detected on the road by vehicle operator.

FIG. 2 is useful in describing the overall operation of the exemplary embodiments. In this example an object 40 is detected on the road by vehicle-A. The driver of vehicle A activates the button 14, which can be referred to without a loss of generality as a hazard flag activator 14. Activation of the button 14 causes the device 12 to transmit the vehicle location data to the ground station 20 that includes the transceiver 26. Once the ground station 20 confirms the significance of the received signal it transmits its findings to those vehicles 10 in the vicinity of the object 40 which will include those vehicles 10' approaching the object 40. The transmission can be a broadcast transmission, a multicast transmission and/or a point-to-point transmission. A vehicle-B that is approaching the location of the object 40 thus obtains an early warning signal to avoid the object 40 and a potential accident is avoided. The vehicle-B 10' can include the device 12 which, in this embodiment, can be integrated with a GPS navigation system having a display 12A, a location transmitter 12B and the button (hazard flag activator) 14. The device 12 can receive hazard coordinated data after agreeing to participate in such a service and thus facilitates implementation of a service oriented embodiment.

Figure 3:
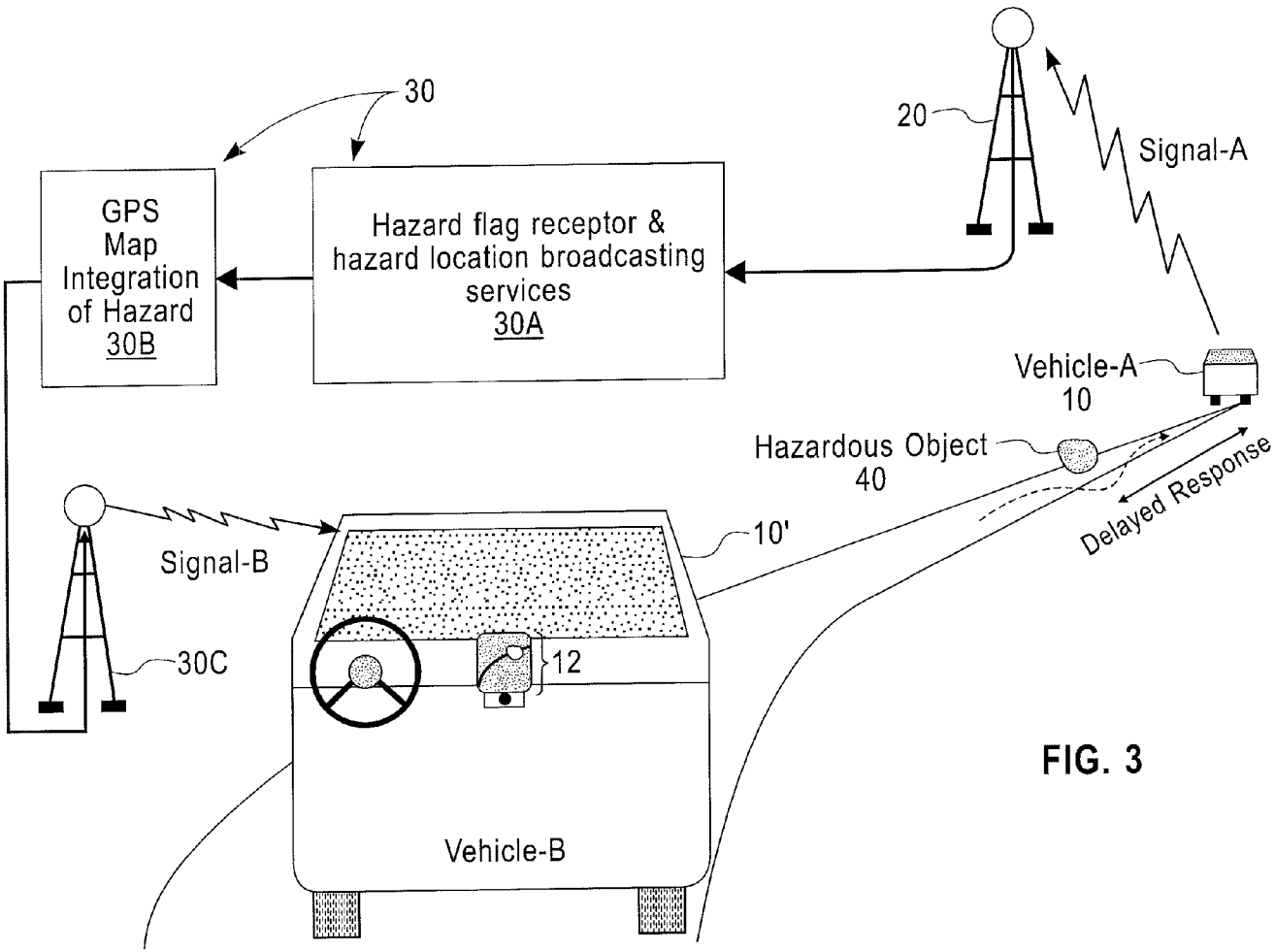
FIG. 3 shows in greater detail the service infrastructure system.

FIG. 3 shows in greater detail the service infrastructure (hazard detection and notification system and algorithms) 30 that establishes a 24/7 computing operation 30A that receives driver responses in the form of the data packets 16 (Signal-A) and processes them using analytics. The hazard information can then be blended with a route map generating service 30B that is transmitted (Signal-B) via a transmission system 30C to the Vehicle-B to facilitate the real time display of the location of the detected hazard to the driver of the Vehicle-B.

Figure 4:
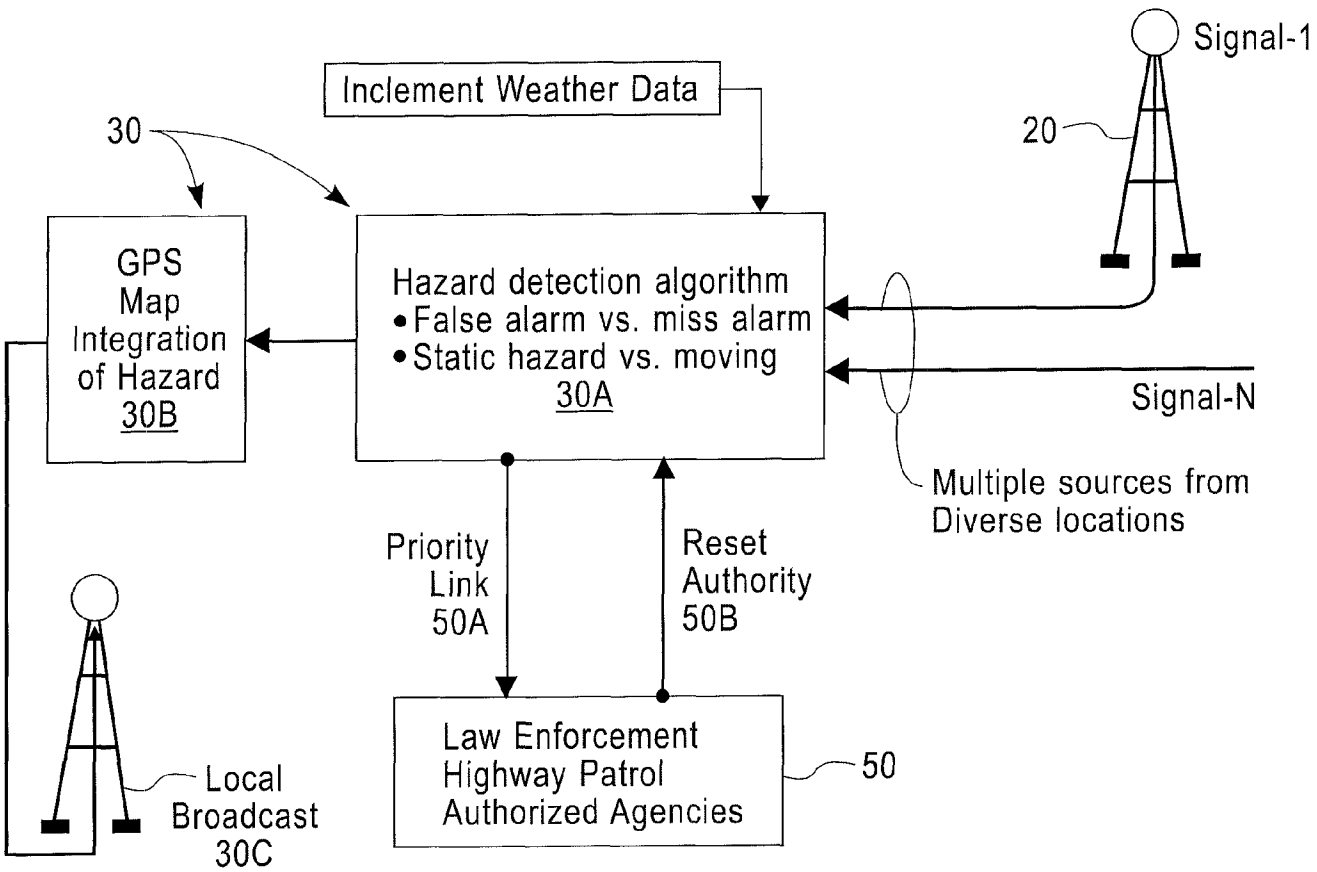
FIG. 4 shows the service infrastructure system connected with various agencies that receive generated hazard information in real time.

FIG. 4 shows the computing operation 30A connected with various exemplary agencies 50 that can receive the generated hazard information, possibly in real time. The computing operation 30A can receive input data from multiple sources besides the ground station 20. For example, it can also receive inclement weather data. The computing operation 30A executes various algorithms such as those designed to discriminate against false alarms and those that differentiate static hazards from dynamic hazards. A priority link 50A can be used for sending real time hazard data to the agencies 50. A reset authority link 50B can be used to indicate to the computing operation 30A when a previously identified hazard has been removed or otherwise rendered harmless (e.g., a disabled vehicle has been towed from the highway).

Figure 5:
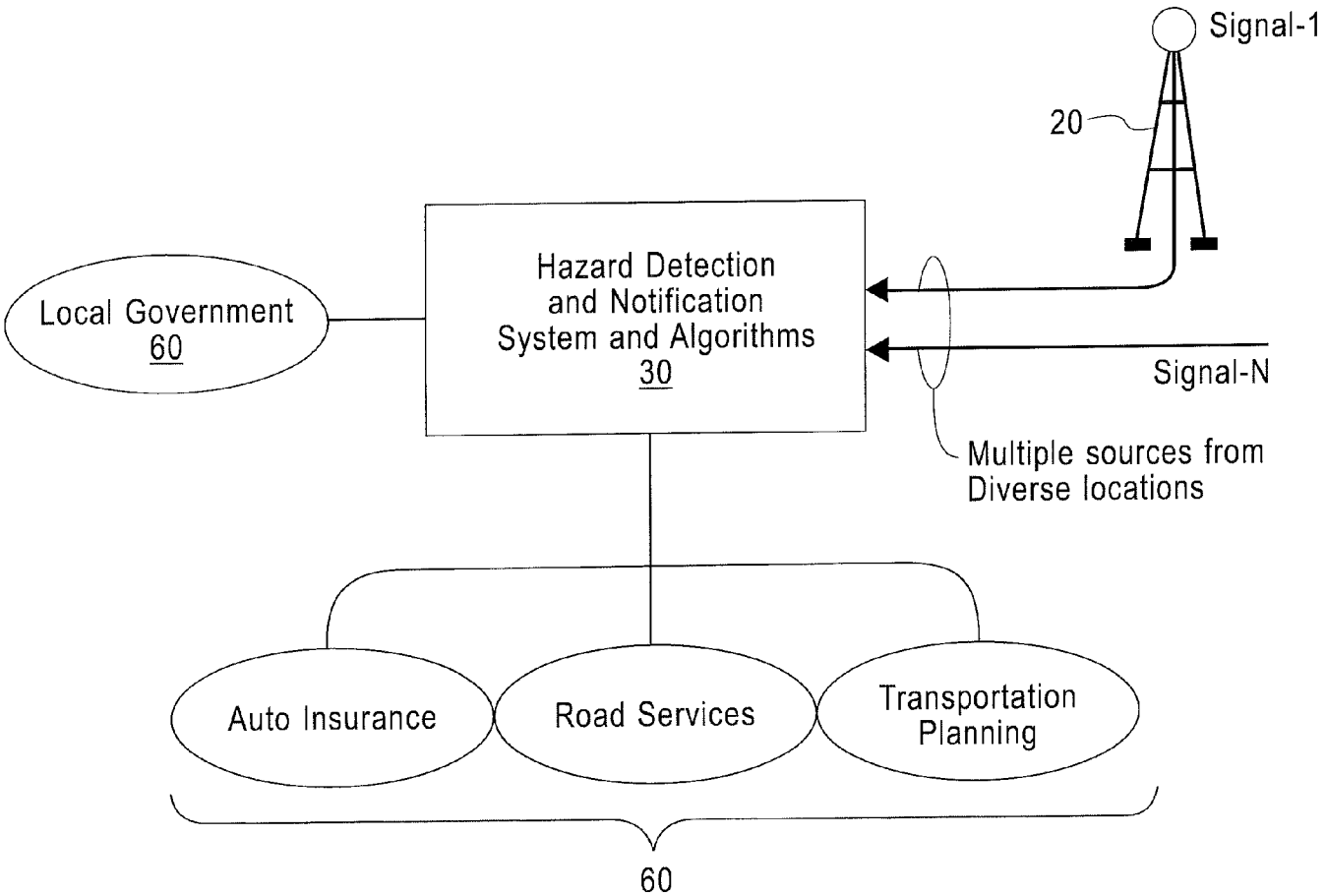
FIG. 5 shows various companies and organizations, referred to generically as customers or partners, with an interest in subscribing to an output of the hazard detection and notification system and algorithms.

FIG. 5 shows various entities such as companies and organizations, referred to generically as consumers 60 of the hazard-related information, that can have an interest in subscribing to the output of the hazard detection and notification system and algorithms 30. These consumers 60 can include, as non-limiting examples, local governments, auto insurance companies, road service providers and transportation planning services.

For example, an insurance company can promote the use of the device 12 among its clients with or without cost. A reduction in cost of insurance can be provided for drivers who are willing to click and transmit hazard instances. On the other hand, a service charge can be levied for customers wanting to receive hazard data. Road service companies can use the output of the system 30 for planning resource utilization.

The output of the hazard detection and notification system and algorithms 30 can be used as well to provide a service to transportation planners, where historic click data concerning, as non-limiting examples, locations of road-side flooding or black ice, can be accumulated by the database 24B and provided for use in planning future improvements.

Figure 6:
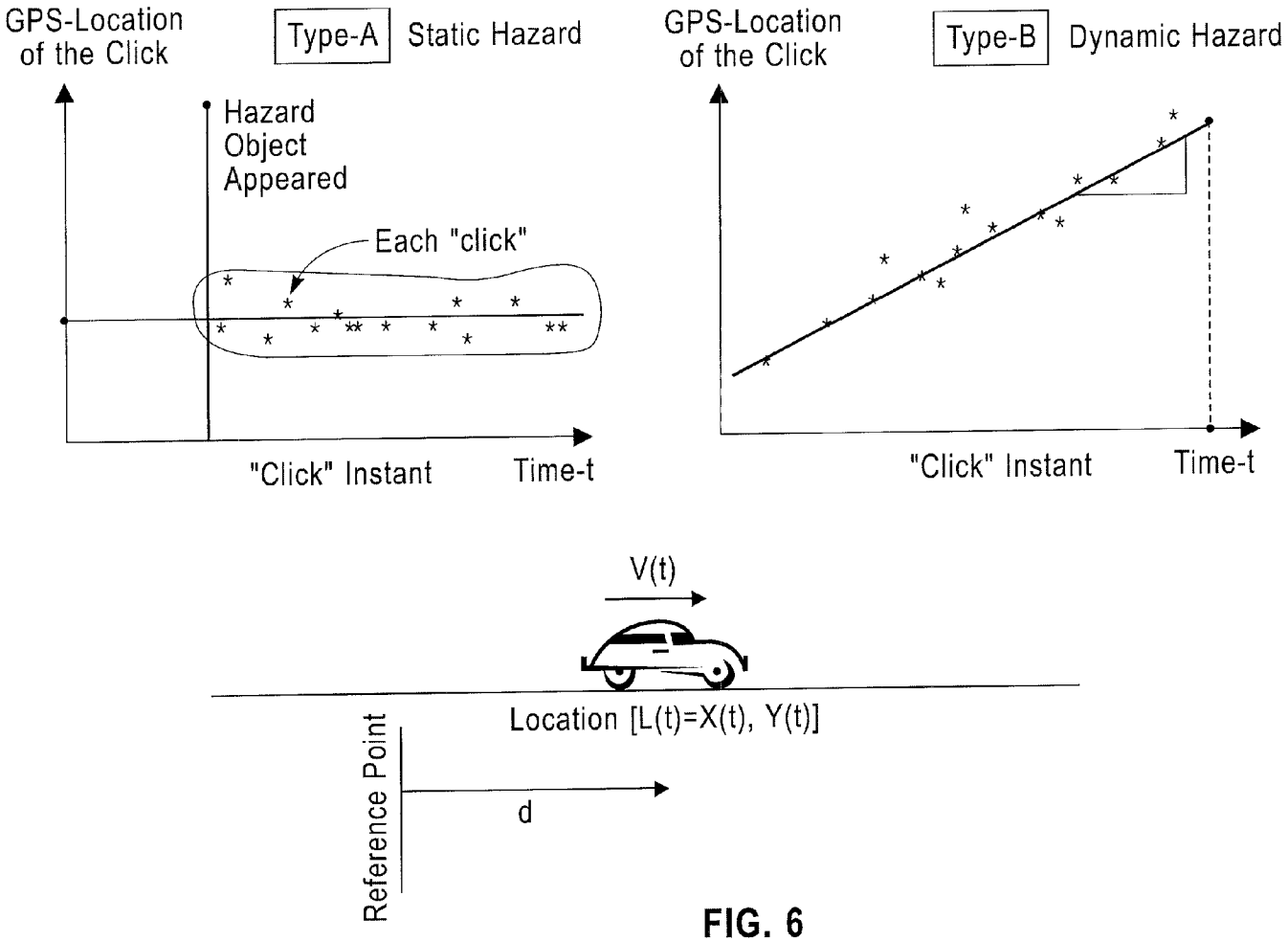
FIG. 6 shows an example of a vehicle traveling at a velocity V(t) and located at a distance d from a reference point at a time instant "t".

FIG. 6 shows an example of a vehicle traveling at a velocity V(t) and located at a distance L(t)=[x(t), y(t)] from a reference point at instant "t". The click emanating from this vehicle is shown as a single data point in the adjoining plots. It can be observed that when click instants are plotted against GPS locations of the clicks that the cluster of data received by the computer 22 of the ground station 20 will have two broad groupings. Type-A correspond to clicks associated with a stationary hazard whereas Type-B corresponds to a dynamically changing hazard.

Figure 7:
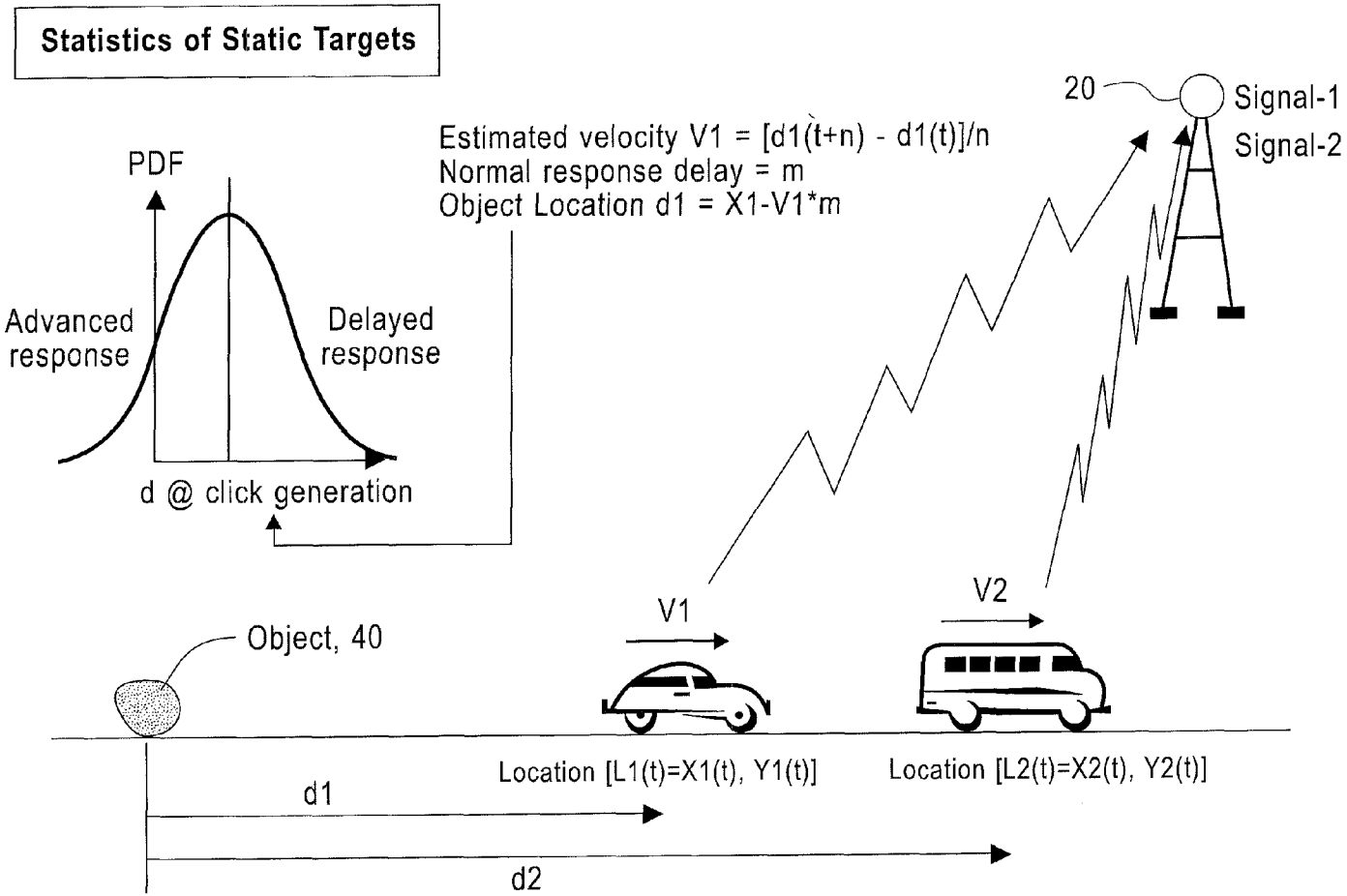
FIG. 7 shows statistics that are involved in estimating the location of a stationary hazardous object.

FIG. 7 shows statistics that are involved in estimating the location of a stationary hazardous object (static hazard). Since each driver (e.g., drivers of vehicles with velocities V1 and V2) will add a variable delay when responding to the presence of an object, the estimation of object location takes into account the speed of a vehicle. Therefore, and unless the data packet 16A also includes the vehicle's speed, the data-packet 16 containing the location information is generated twice (packets 16A and 16B) so that the ground station 20 can process the data. Alternatively the onboard device 12 can compute the average speed, or obtain it from another on-board system, at the moment of the "click" and supply the velocity estimate along with the location data. In FIG. 7 the estimated velocity V1=[d1($t$+$n$)−d1($t$)]/n, the nominal response delay=m and the Object Location d1=X1−V1*m. The PDF (the y-axis of the graph) is the probability density function. A histogram, for example, is representative of the PDF. The PDF is normalized so that the total area under the curve is "1".

Figure 8:
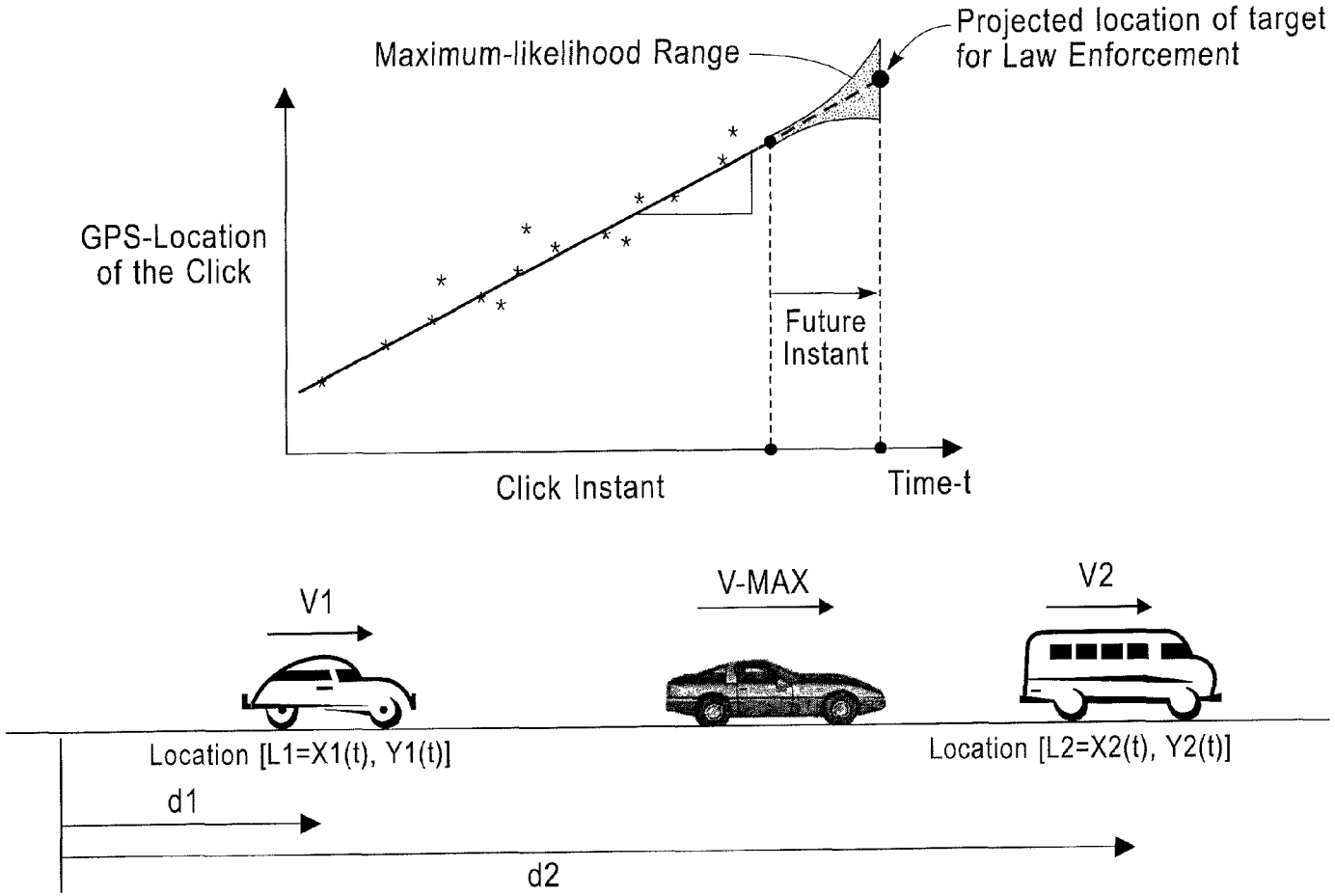
FIG. 8 illustrates an exemplary click pattern (cluster) that corresponds to a moving hazard.

FIG. 8 illustrates a click pattern (cluster) that corresponds to a moving hazard. For example, a reckless driver with a higher speed V-MAX than V1 and V2 would cause other drivers to generate clicks with increasing location change. The slope of the plot (distance vs. time) corresponds to the velocity of the reckless driver with an error term corresponding to a "judgmental" delay of the surrounding vehicles. Estimation theory can be used to enhance the statistical predication capability. For example, for law enforcement purposes a most likely location of the reckless driver at some future instant of time (e.g., in 10 minutes) may be required. A prediction algorithm could be invoked to achieve this task and thus provide a maximum-likelihood range of locations where the recklessly driven vehicle can be found.

Figure 9:
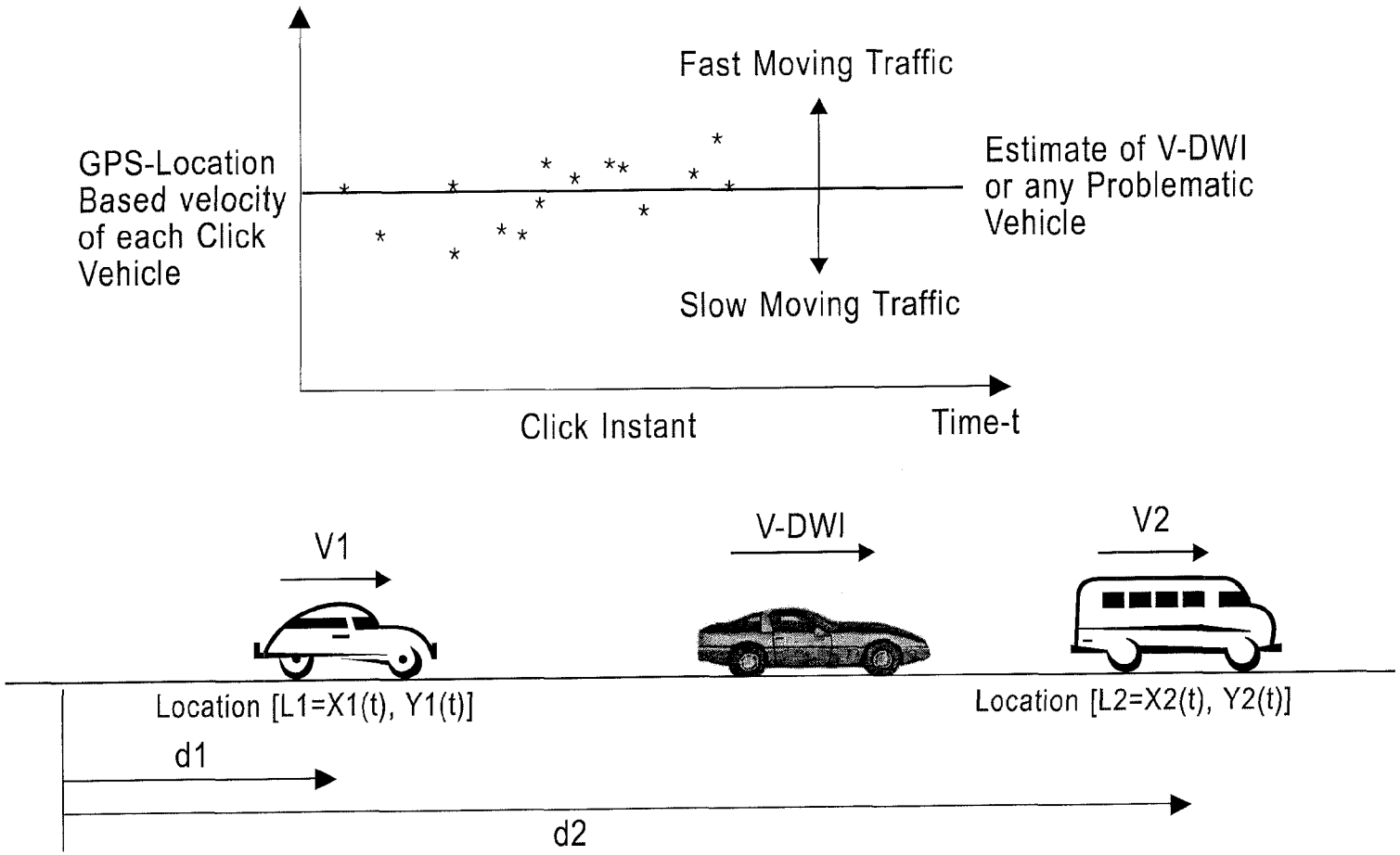
FIG. 9 depicts a situation where a dynamic object, that can be problematic to other drivers, travels at about the same speed as the other drivers.

FIG. 9 depicts a situation where a dynamic object, that can be problematic to other drivers, travels at about the same speed as the other drivers. For example an impaired driver, e.g., driving while intoxicated (DWI), is embedded in a flow of traffic where only the neighboring drivers can judge the situation and make the click. Once a sufficient confidence level is reached the hazard detection and notification system and algorithms 30 can alert law-enforcement and also other drivers of the evolving risk.

Note that the embodiments of FIGS. 8 and 9 involve the hazard detection and notification system and algorithms 30 analyzing received clicks to infer the existence of the dynamic type of transportation hazard, and generally consider the locations of vehicles transmitting information packets 16 and the times of arrival of the information packets 16. In these embodiments the hazard detection and notification system and algorithms 30 is capable of discriminating a transportation hazard that moving with a velocity that differs from the velocities of the vehicles transmitting information packets (FIG. 8), from a transportation hazard moving with a velocity that is about the same as the velocities of the vehicles transmitting information packets (FIG. 9). Note that in the embodiment of FIG. 8 the vehicle that is responsible for the other vehicles generating click data could be traveling faster than the other vehicles (as shown) or it could be traveling slower than the other vehicles. Both of these cases can be detected and resolved.

Figure 10:
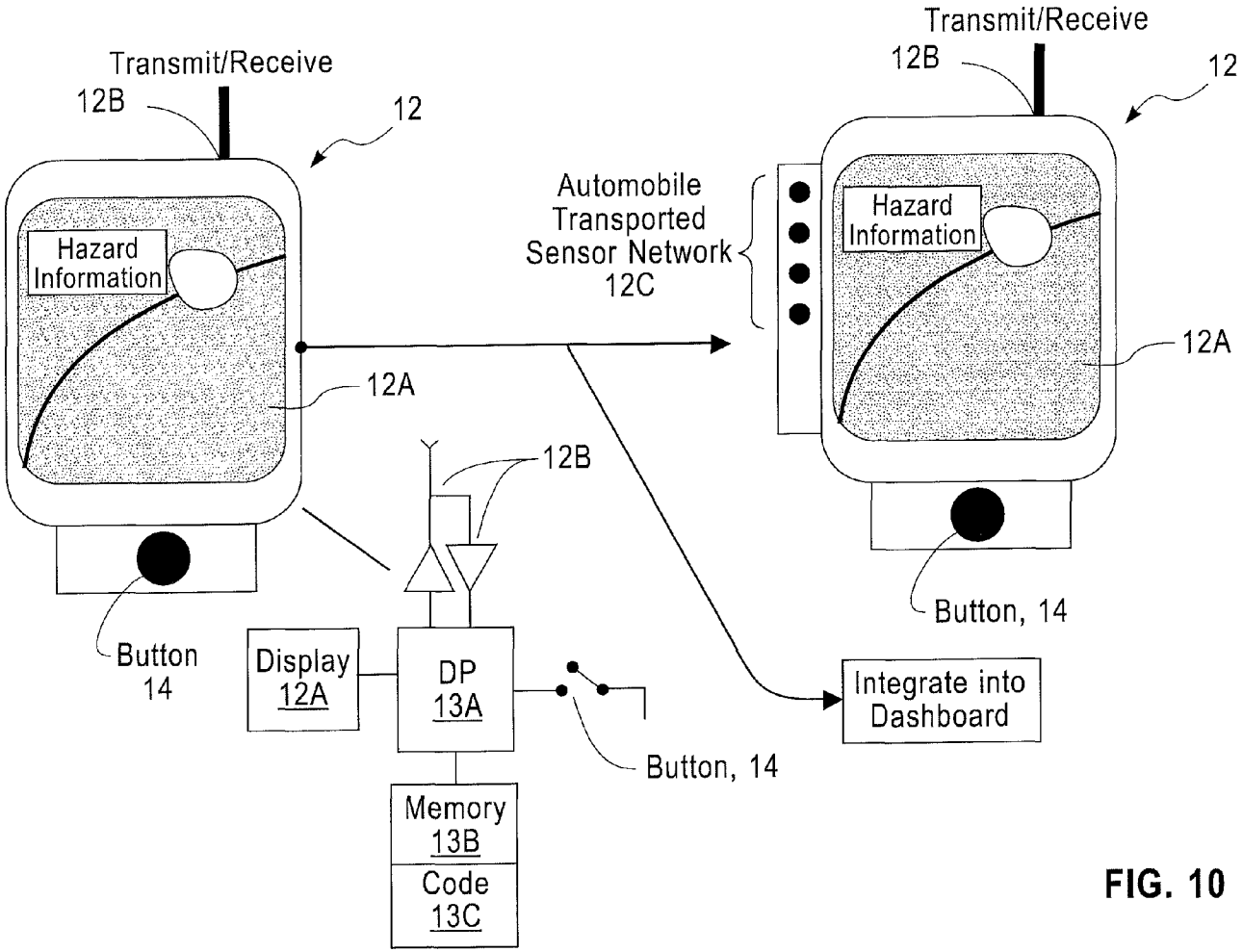
FIG. 10 shows exemplary embodiments of a vehicle device that is operable for generating the click data used by the hazard detection and notification system and algorithms.

FIG. 10 shows exemplary embodiments of the device 12. For example the device 12 is self-contained and includes display 12A, location transmitter 12B and the button (hazard flag activator) 14. The device 12 can include all or some of the functionality of the navigation system 18. While shown as the self-contained package, in some embodiments some or all of this functionality could be integrated into the dash board and/or steering column of the vehicle 10. In a further embodiment the device 12 can be expanded to contain various sensors 12C to enable, for example, sampling of environmental parameters. In some embodiments the functionality of the device 12 can be integrated into a GPS-based vehicle navigation system. In other embodiments the functionality of the device 12 can be integrated into an electronic toll payment system (transponder) that is mounted in the vehicle. In some embodiments the functionality of the GPS-based vehicle navigation system 18, or the functionality of the electronic toll payment system (transponder), can be integrated into the device 12.

The hazard warnings given to the drivers of other vehicles can be graphical, textual or auditory (e.g., using an in-vehicle speech synthesis system). Non-limiting examples of hazard warnings could be "Warning, roadway obstruction 0.2 miles south of exit 22", or "Warning, disabled vehicle in roadway at exit 19", or "Warning, vehicle being driven erratically northbound, presently approaching exit 15". The same or similar information can be relayed to local highway authorities and presented to all drivers on roadside displays and/or as a broadcast on a traffic-related radio channel. After the obstruction or other hazard situation is resolved the warning can be simply terminated, or more information can be provided, e.g., "The obstruction previously located south of exit 22 has been removed".

FIG. 10 also shows an exemplary construction of the device 12, which can include at least one computer or data processor (DP) 13A (e.g., a microprocessor) that is connected with at least one memory 13B storing computer program code 13C that, when executed by the at least one data processor 13A results in the performance of methods of this invention. The device 12 also includes or is connected with the location generator (e.g., the GPS-based navigation system 18) and wireless transmitter 12B, and can also include the display 12A. The user input transducer, such as the button 14, is connected to the data processor 13A for triggering the sending of the one or more information packets 16. Note that while the button 14 can be a simple mechanical switch as shown, in other embodiments it may be a soft button displayed on the display 12A (e.g., a touch-sensitive display). In some embodiments the button 14 can be part of a separate assembly. For example, the device 12 can be integrated into the vehicle dashboard electronics and the button 14 can be located on the steering wheel. In other embodiments the functionality of the button 14 can be realized with an in-vehicle microphone connected with a suitably programmed voice recognition system. For the purposes of describing the various embodiments of this invention any type of transducer (e.g., mechanical, electronic, acoustic, biometric, shown generically as the button 14) that is employed to generate the user (e.g., driver)

input is considered to respond to a manual activation and to generate a manually activated signal.

In some embodiments activation of the button 14 can trigger the data processor 13A to make a query to an in-vehicle location determination system (e.g., the in-vehicle GPS navigation system 18) to obtain the current location of the vehicle 10, which is then incorporated into an information packet 16 and transmitted via the transmitter 12B. In other embodiments the GPS-based navigation system 18 can be an integral part of the device 12. If multiple information packets are transmitted, e.g., the packets 16A and 16B, the data processor can make multiple queries of the navigation system. Other information can also be included, such as the velocity of the vehicle. In addition, the information packet may be composed to also include a unique identifier of the vehicle 10 or the driver (e.g., a subscriber or a customer identification) or of the device 12. Alternatively the information packet(s) may contain no vehicle or driver-related identification information and are thus transmitted anonymously. The use of some type of unique identification of the source of the click signal can be advantageous, as it enables providing a reward system for use of the device 12. The use of some type of unique identification of the source of the click signal can also be advantageous in filtering out or placing less emphasis on click signals received from vehicles having a history of generating rogue click signals, or more generally click signals that are found by the hazard detection and notification system and algorithms 30 in many cases not to correlate with click signals received from other vehicles.

Figure 11:
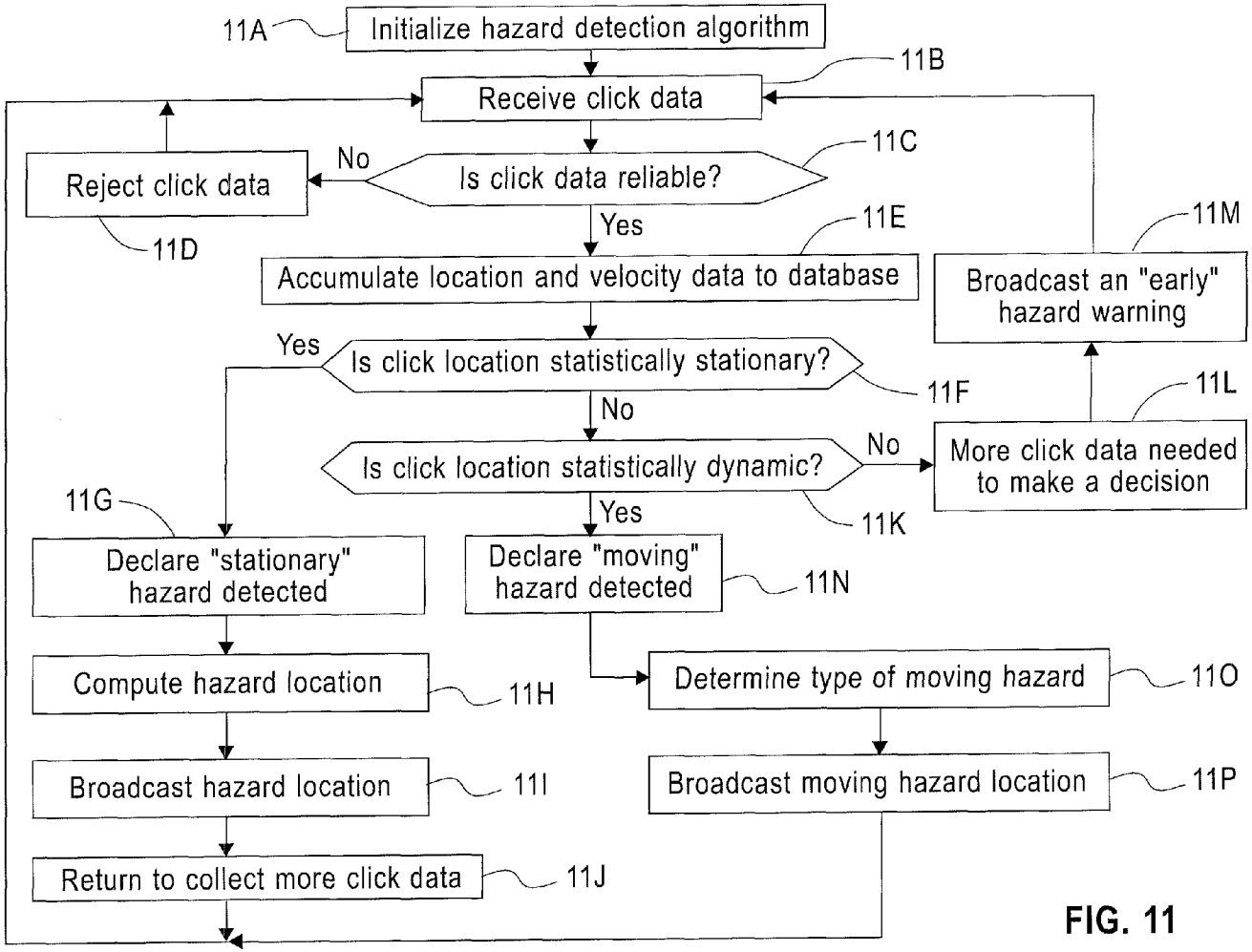
FIG. 11 is a logic flow diagram that depicts an exemplary operation of the hazard detection and notification system and algorithms.

FIG. 11 is a logic flow diagram that depicts the operation of the hazard detection and notification system and algorithms 30. At Block 11A the hazard detection algorithm (part of the computer program code 24A and executed by the data processor 22 of FIG. 1) is initialized. At Block 11B click data is received. The click data is represented by the receipt of an information packet 16 that includes at least the location (e.g., GPS-derived location coordinates) of a vehicle 10. At Block 11C a determination is made if the received click data is reliable. For example, if the location data is substantially separated from a remaining cluster of location data it can be considered as an outlier and therefore treated as unreliable. Drivers with slower reaction times could produce clicks that can be classified as outliers. In situations where drivers passing a hazard from different directions the statistical distribution will become bimodal (i.e., the peak of the probability density function has two humps), and can be processed accordingly without discarding the click data as unreliable.

If the click data is deemed not to be reliable then control passes to Block 11D to reject the received click data, followed by a return to Block 11B to wait to receive the next click data. If the received click data is deemed to be reliable then control instead passes to Block 11E to accumulate the location data and the velocity data to the click data database 24B. If the velocity data is not part of the received click data then it can be derived from the receipt of at least two information packets 16A and 16B as was detailed above. At Block 11F a determination is made, based on a number of received click events stored in the database 24B, if the click location is statistically stationary (as shown in FIG. 6 for the Type-A case). If it is determined that the click location is stationary then control passes to Block 11G to declare the detection of a "stationary" hazard, to Block 11H to compute the location of the stationary hazard, to Block 11I to transmit (e.g., broadcast) the computed location to other vehicles as well as to other interested parties (e.g., as shown in FIG. 5), and then to Block 11J to make a return to Block 11B to collect further click data. At Block 11F if the click location is deemed to not be stationary then control passes to Block 11K to make a determination if the clock location is statistically dynamic (as shown in FIG. 6 for the Type-B case). If not, then at Block 11L a determination is made to accumulate additional click data. At Block 11M an "early" hazard warning may be transmitted to indicate that there is a potential for a hazard to be present at the location(s) indicated by the click data received thus far, followed by a return to Block 11B to accumulate additional click data. If it is determined at Block 11K that the click location(s) are associated with a dynamic hazard then control passes to Block 11N to declare the detection of a dynamic "moving" hazard, to Block 11O to make a determination, if possible, of the type of moving hazard (e.g., as shown in FIGS. 8 and 9), to Block 11P to transmit (e.g., broadcast) the computed current and possibly predicted future location of the moving hazard to other vehicles as well as to other interested parties, and then to make a return to Block 11B to collect further click data.

The use of the exemplary embodiments of this invention provides advantages over systems that rely on one or more electronic sensors contained within the vehicle. The use of such electronic sensors to automatically generate a hazard indication, such as a video camera with image recognition software or a laser-based or an acoustic-based radar system, can be problematic. Such electronic sensors can suffer from inaccuracies related to, for example, ambient weather and lighting conditions and/or the speed of the vehicle. Other types of sensors that may rely on on-board vehicle sensor systems (e.g., tire pressure changes, traction changes, etc.) to automatically generate a hazard indication are also problematic as there can be a variety of hazard types that cannot be detected (e.g., objects adjacent to the roadway, another vehicle that is being operated in an erratic manner). In general such electronic-based sensor systems may be incapable of detecting a potential hazard condition that would be readily discernable to the driver of the vehicle 10. Non-limiting examples of such potential hazards include a herd of deer approaching the roadway, or a tree that is in danger of imminently falling into the roadway.

It should be noted, however, that the use of the device 12 having the manually activated hazard button 14 does not preclude the use of other types of hazard indicators, including one or more electronic hazard sensors contained in the vehicle 10.

Figure 12:
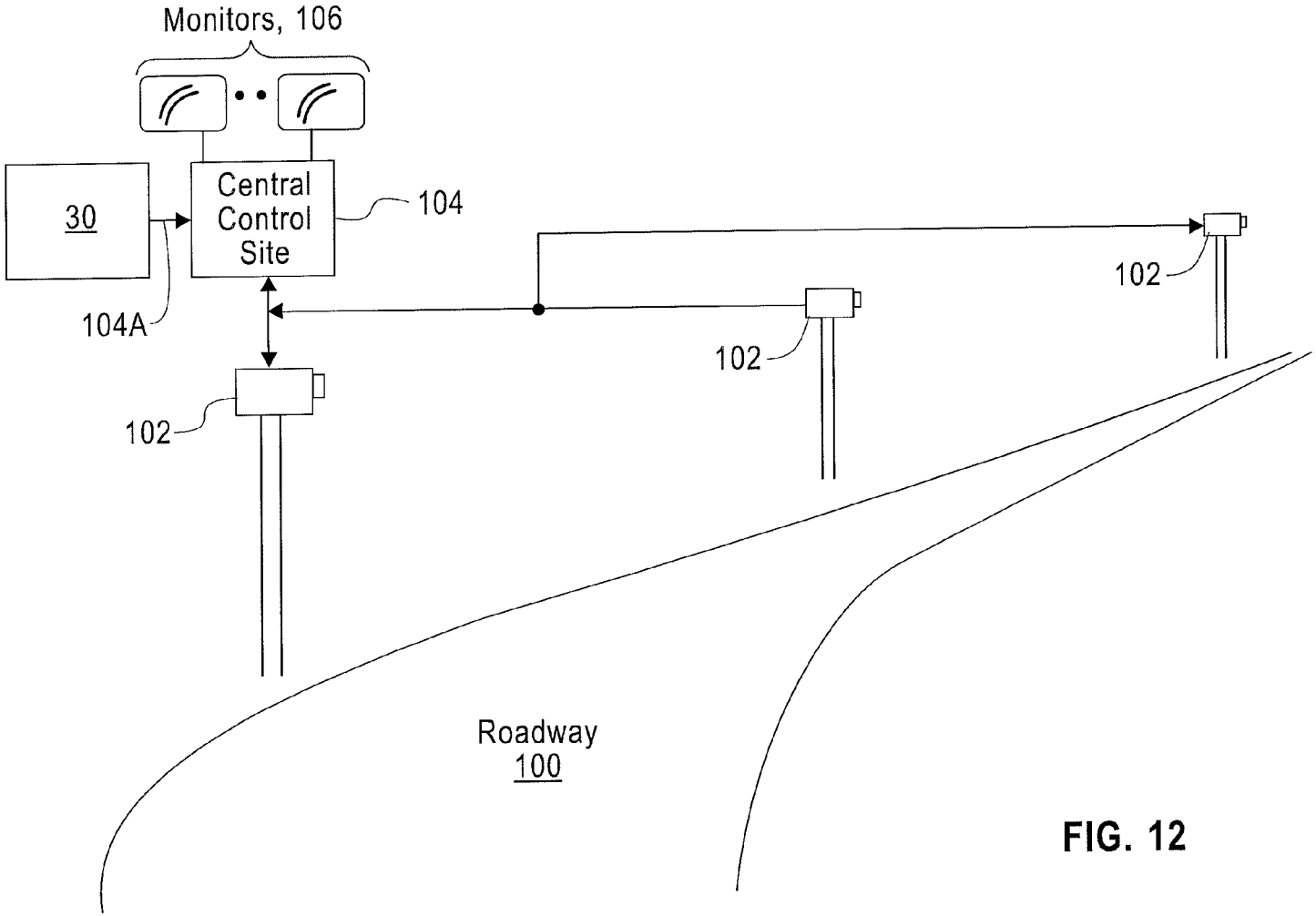
FIG. 12 depicts a roadway having video or still cameras positioned at various locations along the roadway, and that can benefit from receiving an output from the hazard detection and notification system and algorithms.

Further, the use of the exemplary embodiments can be extended to the activation and control of roadside and other imaging infrastructure (e.g., satellite-based imaging). In the non-limiting example shown in FIG. 12 a roadway 100 has video or still cameras 102 positioned at various locations along the roadway 100. The cameras 102 relay image data to a central control site 104 having one or more display monitors 106 for displaying to personnel the images captured by the cameras 102. The central control site 104 may be, for example, administered by a local government (see FIG. 5) highway, bridge and/or freeway authority. In this embodiment the control site 104 receives an input 104A from the hazard detection and notification system and algorithms 30 and, in response to a detected hazard (or a pre-warning of a potential hazard) at a particular location, can manually or automatically change at least one of a certain camera's orientation and zoom ratio in order to acquire an enhanced image of the location of the hazard (or potential hazard). In an embodiment where there are more cameras 102 than display monitors 106 the images from one or more cameras 102 deemed to be capable of imaging the hazard location can be automatically selected for display to the personnel manning the central control site 104.

It should be noted that the hazard type determination steps 11F and 11K of FIG. 11 can be based on some fixed (threshold) number of click data being received from vehicles 10. Alternatively, the number of click data considered (and the threshold value) can be variable. In one exemplary embodiment the click data can be weighted based on one or more criterion, for example, the time of day and/or a record of an average number of vehicles known to pass by an indicated location of a potential hazard at a certain time of day. As a non-limiting example the threshold number of received information packets to declare the existence of a stationary hazard may be Nat a time of day when it is known that at least 1000 vehicles per hour pass a given point, while the threshold number of received information packets to declare the existence of a stationary hazard may be M at a different time of day when it is known that less than 50 vehicles per hour pass the given point, where M is less than N.

Based on the foregoing it should be appreciated that there has been described a method, computer program product and system for providing a real time warning of transportation hazards to a mobile unit via a ground station. This can be achieved, at least in part, by collecting in real time information on transportation hazards as they are encountered by a first mobile observer; transmitting wirelessly the position information of the transportation hazard encountered by a first mobile observer to the ground station; collecting in real time further information on the transportation hazards as they are encountered by at least one other mobile observer; transmitting wirelessly the position information of said transportation hazard encountered by the at least one other mobile observer to the ground station; processing a plurality of the position information received by the ground station to determine a location and at least one other characteristic of the transportation hazard and transmitting the information on the location and characteristics of the transportation hazard to at least one other mobile unit to provide advanced warning of the transportation hazard to the at least one mobile unit receiving the information, where the information is sufficient to avoid the transportation hazard. The road condition can optionally be reset to a "normal" condition after the transportation hazard is no longer present.

Further in accordance with the embodiments of this invention the device 12 having the manually activated click functionality is not limited for use with vehicles (e.g., with automobiles, trucks, motorcycles, watercraft and possibly aircraft), but could be incorporated for use with other modes of user mobility including in any type of device, such as a hand-held device, that is carried by a pedestrian.

It should also be noted that while the exemplary embodiments have been described thus far in the context of reporting and processing roadway hazards, the same, or a variant of, the device 12 having the manually activated click functionality could also be used to provide a service whereby persons could report a medical emergency that they observe on a roadside or in a public place.

It should be noted further that while the exemplary embodiments have been described thus far in the context of reporting and processing roadway hazards, the same, or a variant of, the device 12 having the manually activated click functionality could also be used to provide a service whereby a person under duress (e.g., a person in fear of imminent bodily harm) could request aid. For example, a short time duration activation of the click button 16 can correspond to the presence of a normal roadside hazard as described above, while one or more extended time duration activations of the click button 16 could be interpreted differently by the hazard detection and notification system and algorithms 30 as implying an emergency situation. In this case, and by example, an emergency call (e.g., 911 or equivalent) could be automatically placed from the ground station 20 and the location of the device 12 could be provided during the call.

As was indicated above, in some embodiments the navigation system 18 can be a unit separate from the device 12 while in other embodiments the functionality of the navigation system 18 and the functionality of the device 12, including the button 14, can be integrated into a single unit or device or system that is vehicle mounted or carried by a user. In this case the data processor 13A of FIG. 10 can be connected via an internal bus or other communication path directly to the location determination function, such as the navigation system 18.

The exemplary embodiments are not limited for use with GPS-based location determination techniques, as any type of location determination (e.g., triangulation based on several radio frequency signals) can be used.

The content of the information packets 16 can have, as a minimum configuration, at least the location information and possibly also the time-of-click information (if the time-of-click is not inferred by the ground station 20 based on the received information packets). One general format can be: location, velocity, time-of-click, "other-variables". The other variables can include data from the sensor network 12C shown in FIG. 10. For example, one "other variable" could be air pollution data generated when a driver detects an issue near a chemical plant. Carbon footprint control can require independent monitoring of air quality, and the sensor network 12C can facilitate this type of operation.

For those embodiments where the click duration conveys some meaning/information the duration can be measured directly by the ground station 20 if the packet 16 is transmitted for the entire time that the button 16 is actually depressed. Alternatively, and for an embodiment where the actual amount time that the user depresses the button 16 is decoupled from the packet that is transmitted (e.g., in all cases the packet 16 has a predetermined duration), the packet 16 can include as an additional information element an indication of whether the packet 16 corresponds to a "normal" duration packet or to an "extended" duration packet.

In general, when a digital packet of data is transmitted (e.g., one equivalent to 128 bits of information) to the station 20 the packet's format is predefined and can include leading and trailing edge bits and, between the leading and trailing edge bits, the useful information. In a most typical case where the station 20 receives packets 16 of predetermined fixed length (e.g., 128-bits), one exemplary and non-limiting packet format can be: 16 bits correspond to the leading and trailing edge indicators (packet start (header), packet end delimiters), and the remaining 96 bits (6×16) can be assigned to convey the Device_ID (16 bits), location (16 bits), velocity (16 bits), "click-duration" (16 bits), and two spare data points for the "other sensor" data.

As was noted above, the packet 16 can also include an identifier of the vehicle, or the user, or an identifier of the device 12 transmitting the packet (e.g., a Device_ID). In this case it is within the scope of the exemplary embodiments to provide the user with an ability to selectively enable or disable the sending of the identifying information.

As will be appreciated by one skilled in the art, aspects of the present invention may be embodied as a system, method or computer program product. Accordingly, aspects of the present invention may take the form of an entirely hardware embodiment, an entirely software embodiment (including firmware, resident software, micro-code, etc.) or an embodiment combining software and hardware aspects that may all generally be referred to herein as a "circuit", "module" or "system". Furthermore, aspects of the present invention may take the form of a computer program product embodied in one or more computer readable medium(s) having computer readable program code embodied thereon.

Any combination of one or more computer readable medium(s) may be utilized. The computer readable medium may be a computer readable signal medium or a computer readable storage medium. A computer readable storage medium may be, for example, but not limited to, an electronic, magnetic, optical, electromagnetic, infrared, or semiconductor system, apparatus, or device, or any suitable combination of the foregoing. More specific examples (a non-exhaustive list) of the computer readable storage medium would include the following: an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing. In the context of this document, a computer readable storage medium may be any tangible medium that can contain, or store a program for use by or in connection with an instruction execution system, apparatus, or device.

A computer readable signal medium may include a propagated data signal with computer readable program code embodied therein, for example, in baseband or as part of a carrier wave. Such a propagated signal may take any of a variety of forms, including, but not limited to, electro-magnetic, optical, or any suitable combination thereof. A computer readable signal medium may be any computer readable medium that is not a computer readable storage medium and that can communicate, propagate, or transport a program for use by or in connection with an instruction execution system, apparatus, or device.

Program code embodied on a computer readable medium may be transmitted using any appropriate medium, including but not limited to wireless, wireline, optical fiber cable, RF, etc., or any suitable combination of the foregoing.

Computer program code for carrying out operations for aspects of the present invention may be written in any combination of one or more programming languages, including an object oriented programming language such as Java, Smalltalk, C++ or the like and conventional procedural programming languages, such as the "C" programming language or similar programming languages. The program code may execute entirely on a given computer, partly on the computer, as a stand-alone software package, partly on the local computer and partly on a remote computer or entirely on the remote computer or server. In the latter scenario, the remote computer may be connected to the local computer through any type of network, including a local area network (LAN) or a wide area network (WAN), or the connection may be made to an external computer (for example, through the Internet using an Internet Service Provider).

Aspects of the present invention are described with reference to flowchart illustrations and/or block diagrams of methods, apparatus (systems) and computer program products according to embodiments of the invention. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks.

These computer program instructions may also be stored in a computer readable medium that can direct a computer, other programmable data processing apparatus, or other devices to function in a particular manner, such that the instructions stored in the computer readable medium produce an article of manufacture including instructions which implement the function/act specified in the flowchart and/or block diagram block or blocks.

The computer program instructions may also be loaded onto a computer, other programmable data processing apparatus, or other devices to cause a series of operational steps to be performed on the computer, other programmable apparatus or other devices to produce a computer implemented process such that the instructions which execute on the computer or other programmable apparatus provide processes for implementing the functions/acts specified in the flowchart and/or block diagram block or blocks.

The flowchart and block diagrams in the Figures illustrate the architecture, functionality, and operation of possible implementations of systems, methods and computer program products according to various embodiments of the present invention. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The corresponding structures, materials, acts, and equivalents of all means or step plus function elements in the claims below or that may be included later are intended to include any structure, material, or act for performing the function in combination with other claimed elements as specifically claimed. The description of the present invention has been presented for purposes of illustration and description, but is not intended to be exhaustive or limited to the invention in the form disclosed. Many modifications and variations will be apparent to those of ordinary skill in the art without departing from the scope and spirit of the invention. The exemplary embodiments were chosen and described in order to explain the principles of the invention and the practical applications thereof, and to enable others of ordinary skill in the art to understand the invention for various embodiments with various modifications as are suited to the particular use contemplated.

As such, various modifications and adaptations may become apparent to those skilled in the relevant arts in view of the foregoing description, when read in conjunction with the accompanying drawings and the appended claims. As but some examples, the use of other similar or equivalent mathematical expressions may be used by those skilled in the art. However, all such and similar modifications of the teachings of this invention will still fall within the scope of this invention.

What is claimed is:

1. A method, comprising:

receiving information packets transmitted from a plurality of vehicles, each information packet comprising at least a location of a vehicle that transmits the information packet;

analyzing with a data processor of a service system infrastructure the received plurality of information packets to infer a presence of a transportation hazard at a particular location and to also infer a type of transportation hazard as being one of a static transportation hazard or a dynamic transportation hazard, where a received information packet does not comprise information descriptive of the type of transportation hazard; and transmitting information descriptive of the inferred presence of the transportation hazard at the particular location and the inferred type of transportation hazard for reception at least by vehicles likely to encounter the transportation hazard.

2. The method of claim 1, where a received information packet further comprises a velocity of the vehicle that transmits the information packet.

3. The method of claim 1, where each vehicle transmits at least two information packets, and further comprising determining a velocity of the vehicle based on the two received information packets.

4. The method of claim 1, where an information packet is received in response to a manual activation of an in-vehicle transducer.

5. The method of claim 1, where for a dynamic transportation hazard transmitting the information also transmits a predicted location of the dynamic location hazard at a future time.

6. The method of claim 1, where for a dynamic transportation hazard the method further determines with the data processor of the service system infrastructure a type of dynamic transportation hazard based at least on the received plurality of information packets.

7. The method of claim 1, where the information packets are received over a wireless connection to the plurality of vehicles, and where the information is transmitted over a wireless connection for reception at least by the vehicles likely to encounter the transportation hazard.

8. The method of claim 1, where analyzing to infer the dynamic type of transportation hazard considers locations of vehicles transmitting information packets and times of arrival of the information packets, and discriminates (a) a transportation hazard moving with a velocity that differs from the velocities of the vehicles transmitting information packets from (b) a transportation hazard moving with a velocity that is about the same as the velocities of the vehicles transmitting information packets.

9. The method of claim 1, further comprising sending the information descriptive of the particular location and the type of transportation hazard for reception by at least one consumer of the information other than a vehicle.

10. A computer-readable medium that contains software program instructions, where execution of the software program instructions by at least one data processor results in performance of operations that comprise execution of the method of claim 1.

11. A method comprising:

manually activating a transducer in a vehicle in response to a person traveling in the vehicle observing an actual or a potential transportation hazard; and in response to the manual activation, wirelessly transmitting from the vehicle at least one information packet comprising at least a current location of the vehicle when the information packet is transmitted, where a transmitted information packet does not comprise information descriptive of a type of transportation hazard or any external condition.

12. The method of claim 11, where at least one information packet is transmitted that also includes the velocity of the vehicle.

13. The method of claim 11, where at least one information packet is transmitted that also includes an identification of at least one of the vehicle or a person traveling in the vehicle.

14. A computer-readable medium that contains software program instructions, where execution of the software program instructions by at least one data processor results in performance of operations that comprise execution of the method of claim 11.

15. A system comprising at least one data processor operating in accordance with a computer program, where execution of the computer program results in performing operations that comprise receiving information packets transmitted from a plurality of vehicles, each information packet comprising at least a location of a vehicle that transmits the information packet;

analyzing with the at least one data processor of a service system infrastructure the received plurality of information packets to infer a presence of a transportation hazard at a particular location and to also infer a type of transportation hazard as being one of a static transportation hazard or a dynamic transportation hazard, where a received information packet does not comprise information descriptive of the type of transportation hazard; and transmitting information descriptive of the inferred presence of the transportation hazard at the particular location and the inferred type of transportation hazard for reception at least by vehicles likely to encounter the transportation hazard.

16. The system of claim 15, where a received information packet further comprises a velocity of the vehicle that transmits the information packet.

17. The system of claim 15, where each vehicle transmits at least two information packets, and further comprising determining a velocity of the vehicle based on the two received information packets.

18. The system of claim 15, where an information packet is received in response to a manual activation of an in-vehicle transducer.

19. The system of claim 15, where for a dynamic transportation hazard transmitting the information also transmits a predicted location of the dynamic location hazard at a future time.

20. The system of claim 15, where for a dynamic transportation hazard said processor, when analyzing to infer the dynamic type of transportation hazard, considers locations of vehicles transmitting information packets and times of arrival of the information packets, and discriminates (a) a transportation hazard moving with a velocity that differs from the velocities of the vehicles transmitting information packets from (b) a transportation hazard moving with a velocity that is about the same as the velocities of the vehicles transmitting information packets.

21. The system of claim 15, where the information packets are received via a wireless receiver from the plurality of vehicles, and where the information is transmitted via a wireless transmitter for reception at least by the vehicles likely to encounter the transportation hazard.

22. The system of claim 15, where said processor is further configured to send information descriptive of the particular location and the type of transportation hazard to at least one consumer of the information other than a vehicle.

* * * * *